US008873789B2

(12) United States Patent
Bigeh

(10) Patent No.: US 8,873,789 B2
(45) Date of Patent: Oct. 28, 2014

(54) ARTICULATING MICROPHONE MOUNT

(71) Applicant: Audix Corporation, Wilsonville, OR (US)

(72) Inventor: Fred Bigeh, Wilsonville, OR (US)

(73) Assignee: Audix Corporation, Wilsonville, OR (US)

( * ) Notice: Subject to any disclaimer, the term of this patent is extended or adjusted under 35 U.S.C. 154(b) by 0 days.

(21) Appl. No.: 13/959,141

(22) Filed: Aug. 5, 2013

(65) Prior Publication Data

US 2014/0064547 A1 Mar. 6, 2014

Related U.S. Application Data

(60) Provisional application No. 61/697,332, filed on Sep. 6, 2012.

(51) Int. Cl.
*H04R 17/02* (2006.01)
*H04R 1/08* (2006.01)

(52) U.S. Cl.
CPC ..... *H04R 1/083* (2013.01); *H04R 1/08* (2013.01); *H04R 2201/025* (2013.01)
USPC ..... 381/361; 381/355

(58) Field of Classification Search
CPC ..... H04R 1/08; H04R 1/083; H04R 2201/025
USPC ..... 381/361–368, 355; 248/516, 130, 131, 248/179.1, 181.1
See application file for complete search history.

(56) References Cited

U.S. PATENT DOCUMENTS

| | | | | |
|---|---|---|---|---|
| 4,721,274 | A * | 1/1988 | Erb | 248/179.1 |
| 4,974,802 | A * | 12/1990 | Hendren | 248/181.1 |
| 2008/0121767 | A1 * | 5/2008 | Wimberley | 248/181.1 |
| 2013/0264450 | A1 | 10/2013 | Bigeh | |

* cited by examiner

*Primary Examiner* — Tuan D Nguyen
(74) *Attorney, Agent, or Firm* — Hancock Hughey LLP

(57) ABSTRACT

A microphone having an integral ball along the microphone body is mounted in a housing that defines a socket for receiving the ball. The microphone may be articulated on the ball and socket mount and the resistance to the articulation force may be varied by tightening and loosening a slotted cap that exerts a spring force on the microphone. The microphone and housing may be mounted to a surface such as a wall or ceiling and plenum ratings may be maintained through ceiling mounts.

15 Claims, 3 Drawing Sheets

ARTICULATING MICROPHONE MOUNT

TECHNICAL FIELD

The present invention relates to an apparatus for mounting electronics equipment including audio equipment such as microphones, and more specifically is an articulating mount that utilizes a ball and socket type of pivot for improved control over audio equipment positioning.

BACKGROUND

Properly positioning audio equipment such as a microphone is a constant challenge in order to maximize the performance of sound reproduction. Depending on the intended use of a microphone, different mounting equipment may be needed. For example, there are different mounting considerations and requirements for mounting a microphone that is being used to amplify sound emanating from a drum than exist when using a microphone to amplify sound that is originating at a distance from the microphone. Regardless of what kind of microphone is being used and what instrument or device is being amplified through the microphone, it is always important to have the microphone oriented relative to and spaced apart from the instrument in appropriate manners.

Given the great variety of mounting situations, there are many types and designs of microphone mounts on the market today. Many of these mounts allow for adjustable positioning of the microphone on the mounting device. However, there is a continuing need for mounting apparatus for a microphone or other audio equipment that is adaptable to a variety of different mounting needs and which provides for a broad range of control over microphone positioning.

The invention described herein and illustrated in the drawings is defined by a mounting apparatus that allows for significant freedom and ease of movement for an electronics device such as a microphone on a surface such as a ceiling or wall so that the microphone may be properly positioned in order to maximize performance.

The mounting apparatus has a main housing member that mounts to an opening formed in a surface. The main housing has a central "socket" into which a microphone that has an integral "ball" formed as part of the microphone is received. A slotted cap threads onto the housing and the slots in combination with an O-ring provide a compressive and spring-like force that allows the microphone to be articulated and positioned accurately.

BRIEF DESCRIPTION OF THE DRAWINGS

The invention will be better understood and its numerous objects and advantages will be apparent by reference to the following detailed description of the invention when taken in conjunction with the following drawings.

FIG. 6*a* is a top plan view of the slotted cap.

FIG. 6*b* is a side elevation view thereof.

FIG. 6*c* is an upper perspective view thereof.

FIG. 6*d* is a bottom plan view thereof.

DETAILED DESCRIPTION OF ILLUSTRATED EMBODIMENTS

Figure 1:
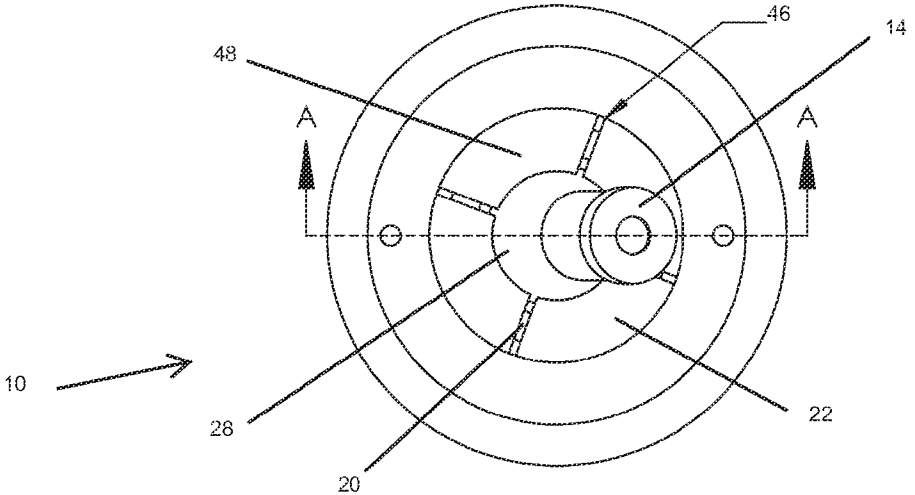
FIG. 1 is a top perspective view of an articulating mount according to the present invention.
Figure 2:
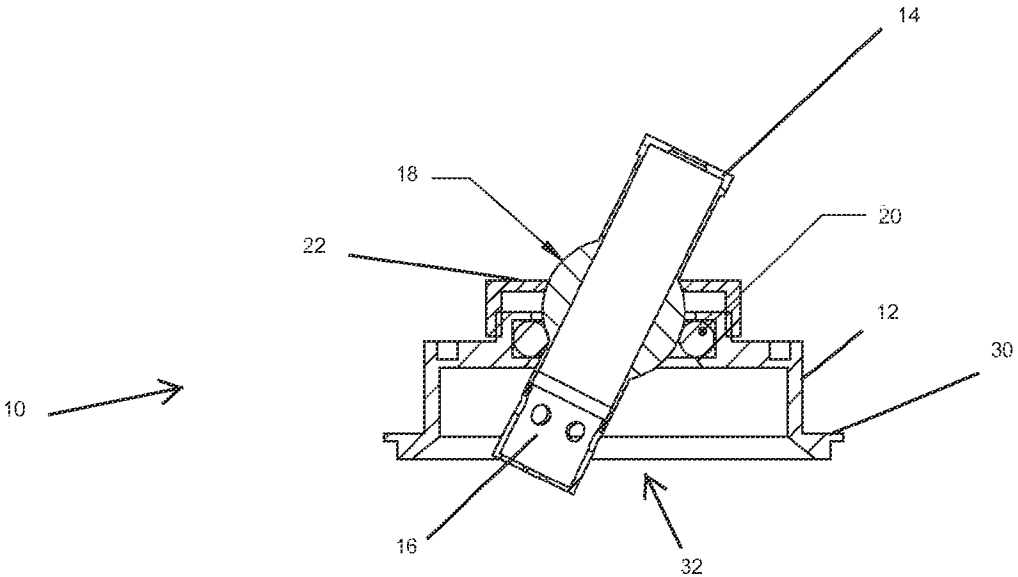
FIG. 2 is a side cross sectional view taken along the line A-A of FIG. 1.
Figure 3:
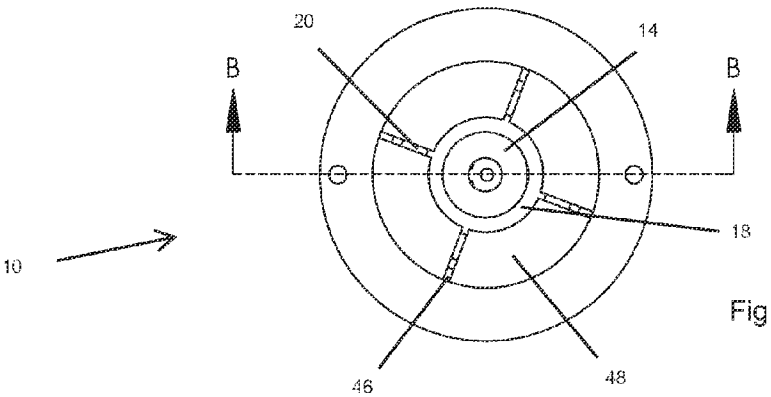
FIG. 3 is a top plan view of the articulating mount of the present invention.
Figure 4:
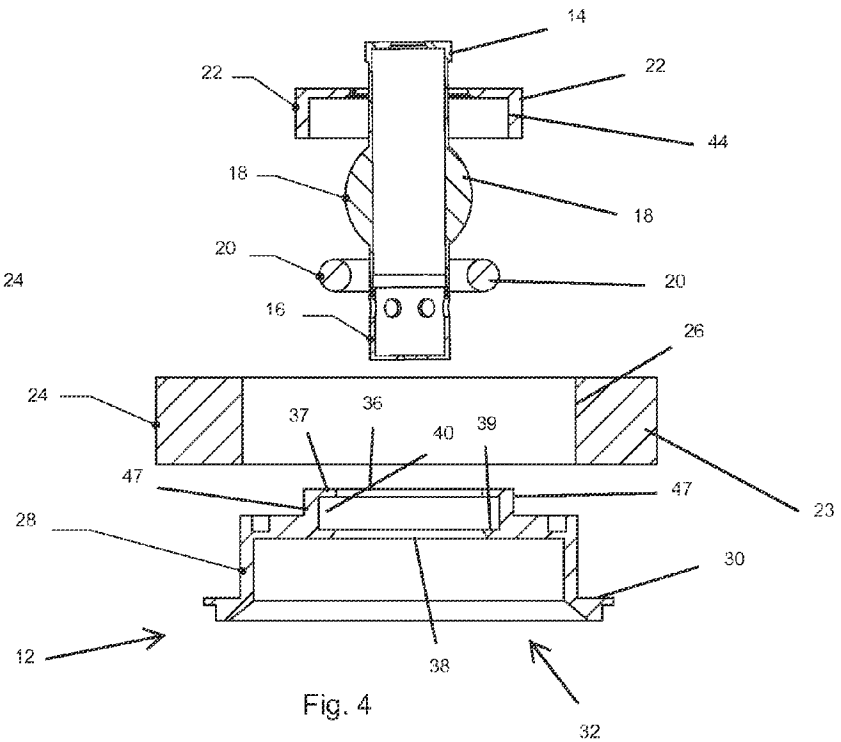
FIG. 4 is a side cross sectional and exploded view taken along the line B-B of FIG. 3, and illustrating the surface on which the mount is mounted.
Figure 5:
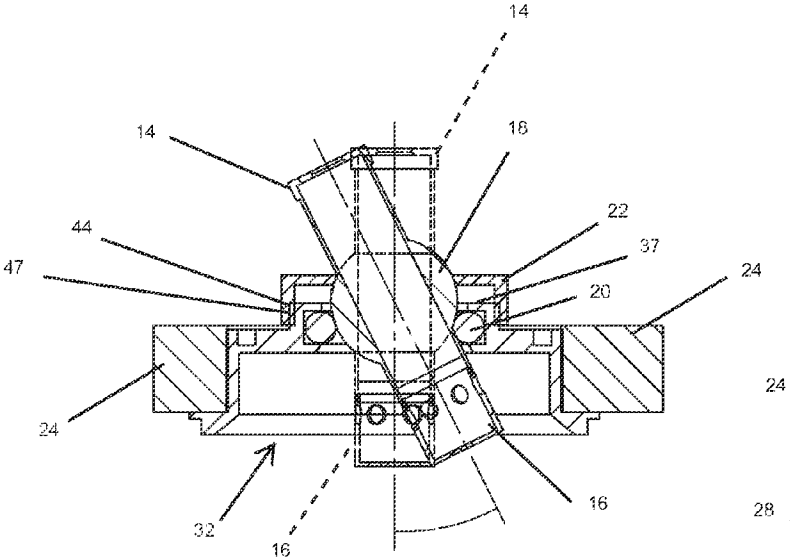
FIG. 5 is a side cross sectional view illustrating the articulation of the microphone in the mount according to the present invention.
Figure 6A:
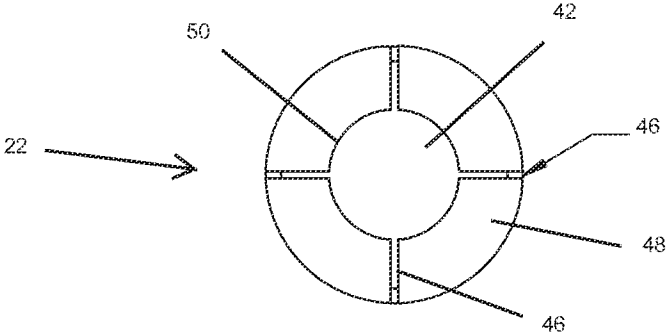
FIGS. 6*a* through 6*d* are a series of views of the slotted cap utilized with the present invention. Specifically.
Figure 6B:
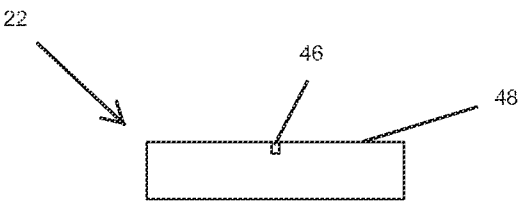
Figure 6C:
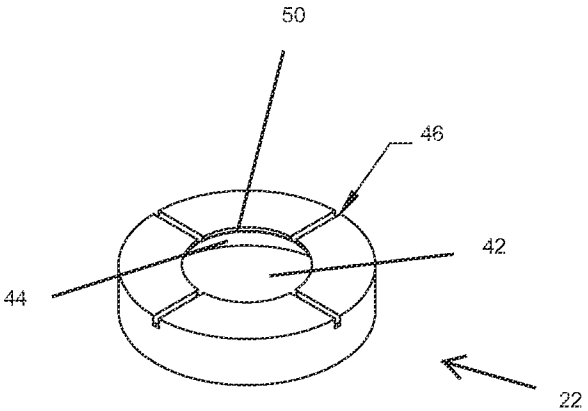
Figure 6D:
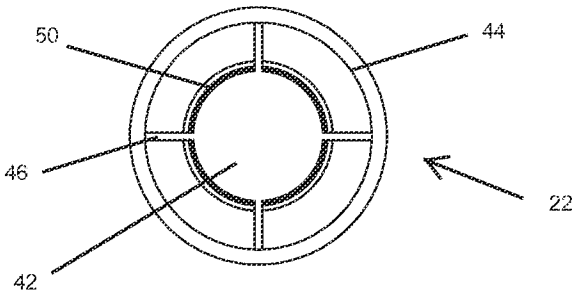

A first illustrated embodiment of a mount 10 according to the present invention is shown in the drawing figures. With reference to FIGS. 1 and 2, mount 10 is defined by a main housing 12, a microphone 14 that comprises a microphone capsule 16 and an integrated, spherically-shaped ball 18 approximately midway along the length of the microphone, an O-ring 20 and a slotted cap 22. The mount 10 is mounted to a surface such as a ceiling, wall or floor, or to a surface on another piece of equipment. In any event, the surface to which the mount 10 is mounted has a bore formed therein through which the main housing 12 is inserted from one side and attached. With reference to FIGS. 4 and 5, the mount 10 is shown being mounted to a wall or ceiling 24. The wall or ceiling 24 has a circular bore 26 formed therein with a diameter the same size as the diameter of the primary wall section 28 of main housing 12. The main housing 12 is inserted into the bore 26 from one side of the wall (as illustrated) until a lip 30 having a larger diameter than the bore 26 abuts the facing surface of the wall 24. The housing is attached to the wall in this installed position with appropriate fasteners.

The interior portion 32 of main housing 12 is generally open and defines a socket 34 formed by an upper opening 36 defined by a circumferential and inwardly projecting shelf 37 and an identically sized lower opening 38 defined by a circumferential and inwardly projecting shelf 39 that is spaced from the upper opening. An internal annular and circumferential slot 40 is defined between shelves 37 and 39 and the slot 40 is sized to receive and retain the O-ring 20.

The microphone 14 has a ball 18 formed as an integral part of the microphone body and located at a desired position along the length of the microphone—as shown herein, the ball 18 is about midway along the length of the microphone. The ball 18 may be fabricated as part of the microphone body or added as a separate part. The diameter of the enlarged portion defined by the ball 18 is greater than the diameter of the opening defined by O-ring 20 and upper opening 36 so that when the end of the microphone 14 is inserted into the housing 12 the ball 18 is received on and supported by the O-ring 20.

Turning to the series of FIGS. 6*a* through 6*d*, the slotted cap 22 has a circumferential central opening 42, internal threads 44 on the inner wall of the cap and plural slots 46 formed around the shoulder 48 of the cap and extending through the shoulder and radially outwardly from the central opening 42 and terminating at the edge of the shoulder 48. The diameter of central opening 42 is less than the diameter of ball 18.

The mount 10 is assembled by first attaching the main housing 12 to the wall 24 in the manner described above. The O-ring 20 is then installed into slot 40 and the microphone 14 is inserted through the opening 36 until the ball 18 rests on O-ring 22. The slotted cap is then attached to the main housing by inserting the upper, exposed end of microphone 14 through the opening 42 in the slotted cap 22 and threading the cap onto the housing—internal threads 44 of slotted cap 22 are threaded onto external threads 47 on main housing 12. As shown in the figures, the central opening 42 of slotted cap 22 has a diameter that is larger than the diameter of the elongate body of the microphone 14 but smaller than the diameter of the ball 18. Accordingly, when the cap 22 is threaded onto the housing 12 a portion of the ball 18 extends through the central opening 42 of the slotted cap 22.

With the mount 10 assembled as described and as shown in the drawings, the microphone 14 may be freely articulated as shown in FIG. 5. When a desired position for the microphone is achieved, the microphone will remain in that position until it is affirmatively and intentionally moved.

As the slotted cap 22 is tightened onto the main housing 12 the ball 18 is compressed between the O-ring 20 and the interior of slotted cap 22, and more particularly, the inner circumferential walls 50 of the central opening 42, which are preferably inwardly chamfered to closely adapt to the spherical outer surface of the ball 18 bear on the ball and exert pressure thereon. As the slotted cap is tightened, the resistance to articulation of the microphone 14 is increased because the pressure applied to the ball by the cap increases. The slots 46 tend to open or deflect as the slotted cap is tightened onto the main housing. This gives the cap to act as a spring tensioning means to maintain articulation resistance even with variations in temperature, and assembly and tolerance variations. Stated another way, the portions of shoulder 48 between slots 46 define resilient tabs that exert a spring force on the ball 18 when the cap 22 is tightened onto the housing. It will be appreciated that as the slotted cap is loosened, the resistance to articulation is decreased. Thus, as the slotted cap is loosened, the slots 46 close toward their normal positions and the pressure exerted on ball 18 (i.e., the pressure that pushes ball 18 into O-ring 22) is decreased. It will further be appreciated that the microphone may be oriented to the desired position relative to the housing as noted above, and then fixed in that position by tightening the cap onto the housing sufficiently to prevent further articulation of the microphone. The slotted cap 22 thus defines a mechanism both for retaining the microphone in its position in the housing and for locking and unlocking the position of the microphone 14 relative to the housing 12.

As noted above, mount 10 is adapted to be mounted to a surface such as a wall 24. The surface may be a wall, a floor, a ceiling or some other surface such as a cabinet. Many other possibilities exist. As an illustration of a specific mounting location, the mount may be attached to a ceiling in a manner that is compatible with maintaining plenum ratings in the building. In building codes, fire codes and similar ordinances for many localities there are specific requirements for creating a plenum between the living or working space and the space above a drop ceiling. When a microphone or the microphone cable is extended through the drop ceiling, the cable may destroy the plenum rating of the installation by creating a passageway from the occupied space to the space above the drop ceiling. In order to maintain the plenum rating, the opening through the ceiling where the cable extends through the ceiling is often sealed to prevent passing of air through the opening. Alternately, the cable may be run under the ceiling rather than passing it through the ceiling. This tends to be unsightly.

The present invention may be mounted to a ceiling while maintaining the plenum rating. This is done by sealing the plenum side of the microphone (above the ceiling tile 24) in a plenum-rated enclosure. Alternately, the plenum rating of a structure may be maintained by using plenum a rated O-ring, seal and microphone cabling with the mount 10.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. A microphone mount, comprising:

a housing having a central opening and an annular slot extending around said central opening;

an O-ring in said annular slot;

a microphone having an elongate body and a spherically shaped ball on the body, said microphone inserted into the annular opening of the body such that the ball abuts said O-ring; and a cap having an opening with plural through slots formed in a shoulder of said cap and extending radially from the opening;

wherein when the microphone elongate body is inserted through the circumferential opening of the cap and the cap is attached to the housing the cap exerts pressure on the ball.

2. The microphone mount according to claim 1 wherein the microphone may be articulated in the mount and wherein the pressure exerted on the ball by the cap causes resistance to articulation of the microphone.

3. The microphone mount according to claim 2 in which the resistance to articulation of the microphone may be adjusted by adjusting the cap.

4. The microphone mount according to claim 3 in which the cap is threaded onto the housing.

5. The microphone mount according to claim 4 wherein tightening the cap on the housing increases the pressure exerted on the ball by the cap to increase the resistance to articulation of the microphone.

6. The microphone mount according to claim 1 wherein the ball is retained between the cap and the O-ring when the cap is attached to the housing.

7. The microphone mount according to claim 6 wherein the opening in the cap is chamfered.

8. The microphone mount according to claim 7 wherein the cap is threaded onto the housing and tightening the cap onto the housing increases the pressure on the ball as the ball is retained between the O-ring and the cap.

9. The microphone mount according to claim 7 wherein the slots in the cap define plural resilient tabs therebetween and said plural tabs deflect as the cap is tightened onto the housing.

10. A microphone mount, comprising:

a housing having a circular opening and a compressible O-ring extending around the opening, the O-ring defining a first diameter;

a microphone having an elongate body with a first end and a second end and an enlarged portion on the elongate body between the first and second ends, the enlarged portion defining a second diameter that is greater than the first diameter;

a cap having a circular opening that defines a third diameter that is less than the second diameter, said cap further having a shoulder extending outwardly from said circular opening and terminating at an edge portion of said cap, said cap including plural slots formed through said shoulder and extending radially from the circular opening and terminating adjacent said edge portion to define plural;

wherein, when the first end of the microphone elongate body is inserted into the circular opening of the housing and the enlarged portion engages the O-ring, and the second end of the microphone elongate body is inserted into the circumferential opening of the cap and the cap is attached to the housing, the cap compresses the enlarged portion between the O-ring and the cap to thereby stabilize the position of the microphone relative to the housing.

11. The microphone mount according to claim 10 wherein the plural slots in the cap define plural tabs between adjacent slots and said tabs are resilient.

12. The microphone mount according to claim 11 wherein the cap may be tightened against said housing and said tabs apply pressure against said enlarged portion when said cap is tightened.

13. The microphone mount according to claim 12 wherein an inner edge of said opening in the cap is chamfered.

14. The microphone mount according to claim 13 wherein the cap is threaded onto the housing and tightening the cap against the housing increases the pressure applied to the enlarged portion by the plural tabs.

15. The microphone mount according to claim 14 wherein the tabs in the cap deflect as the cap is tightened onto the housing.

* * * * *